US005653544A

United States Patent [19]

Cabre Pijoan et al.

[11] Patent Number: 5,653,544

[45] Date of Patent: Aug. 5, 1997

[54] DEVICE FOR THE PERMANENT BINDING OF SHEAVES OF PAPER AND METHOD FOR THE FASTENING OF SHEAVES OF PAPER USING SAID DEVICE

[75] Inventors: Jordi Cabre Pijoan, Montbrio; Manuel Pijuan Duch; Xavier Busquets Fontgibell, both of Tarragona, all of Spain

[73] Assignee: Asesoria Y Gestion Ediciones, S.L., Tarragona, Spain

[21] Appl. No.: 570,341

[22] Filed: Dec. 11, 1995

[30] Foreign Application Priority Data

Dec. 15, 1994 [ES] Spain ..... 9402560

[51] Int. Cl.[6] ..... B42F 3/00

[52] U.S. Cl. ..... 402/64; 402/60

[58] Field of Search ..... 402/60–68

[56] References Cited

U.S. PATENT DOCUMENTS

| | | | |
|---|---|---|---|
| 1,675,277 | 6/1928 | Roe . | |
| 2,891,554 | 6/1959 | Foster | 402/64 |
| 3,083,714 | 4/1963 | Foster | 402/64 |
| 3,251,260 | 5/1966 | Serdechny | 402/63 |
| 3,757,389 | 9/1973 | Wiland | 402/68 X |

FOREIGN PATENT DOCUMENTS

| | | |
|---|---|---|
| 212973 | 3/1987 | European Pat. Off. . |
| 3204087 | 8/1983 | Germany . |
| 2252938 | 8/1992 | United Kingdom . |

*Primary Examiner*—Willmon Fridie, Jr.
*Attorney, Agent, or Firm*—Cushman, Darby & Cushman IP Group of Pillsbury Madison & Sutro LLP

[57] ABSTRACT

A device for the permanent binding of sheaves of paper and method for using it to fasten sheaves of paper are disclosed. The device includes a rod made from synthetic material whose diameter is smaller than that of the perforations in the sheaf of paper to be joined, ending at one end in a checker stop for limiting insertion and in the other end in an entry zone of diminishing section. The rod is fitted with a metallic, cylindrical and hollow sleeve, whose outside diameter is slightly less than that of the perforations of the sheets to be joined. At one end, the sleeve has a checker stop for limiting insertion into the sheaf of paper and, at the other end and on the inside of the opening an annular engaging surface having a diameter which is slightly smaller than that of the rod. When sleeve is moved over the rod, the engaging surface engages the rod to retain the rod.

5 Claims, 5 Drawing Sheets

DEVICE FOR THE PERMANENT BINDING OF SHEAVES OF PAPER AND METHOD FOR THE FASTENING OF SHEAVES OF PAPER USING SAID DEVICE

BACKGROUND OF THE INVENTION

The aim of the present invention is to provide a new device that is used to join or fasten sheaves of paper in a permanent fashion. The present invention also refers to a method used for the fastening of sheaves of paper, using the above device.

At present there are many systems in use to securely join sheaves of paper either in a temporary or permanent fashion. Devices currently known include different types of the so-called binders that, once inserted into holes previously made in the sheets of paper, enable same to be held in place with the help of sidepiece deformation systems, screw and nut systems and others. Also, there are systems that employ lamination of the sheet joining area or of the spine of the sheaf of paper when binding takes place.

All the known systems are somewhat inconvenient, because of the time they take, and because in some cases the cost of the components is relatively high, resulting, overall, in quite labour-intensive and highly cost-intensive products.

The device of the present invention is aimed at providing a new method for fastening sheaves of paper and is of great inventive interest in that it allows the secure joining of sheaves of paper in a speedy and effective manner. The features of its use include great originality and speed, and the parts used in the device are very simple and of low cost.

The device of the present invention will be particularly suitable for the permanent joining of sheaves of paper, such as is required in many cases where the aforesaid sheaves of paper are to be filed. One such application is the filing of computer lists. In this case, numerous sheaves of computer listing paper are to be joined. Computer listing paper already has perforations down its side, located on the strip and centred within it, which can be used for the purpose of binding the sheaves of paper.

SUMMARY OF THE INVENTION

The device of the present invention essentially comprises two complementary components, one of which is a rod or spike of variable length, preferably made from a relatively hard and resistant plastic material. Its outside diameter is considerably smaller than the diameter of the holes in the sheets to be joined, so that once the sheets to be joined are in a sheaf, it will be easy to insert said rod into the corresponding holes, while leaving sufficient play. The aforementioned rod has a checker head at one end that should coincide with the relevant side of the sheaf of paper to be joined, whereby the position of introduction of the rod is fixed. The device is fitted with a hollow-type sleeve, preferably made from metal, with an outside diameter that is slightly smaller than that of the holes in the sheaf of paper for binding. The sleeve's inside diameter is slightly larger than the outside diameter of the rod. The essential feature of the sleeve is that, at one end of the inside opening it has a ring-shaped area facing the inside of the opening, the diameter of which is slightly smaller than the outside diameter of the rod, finishing inside in a sharp holding edge. On the outside, at the opposite end to that of the aforementioned ring-shaped projection, the sleeve has an outside stopper for position limitation, corresponding with one side of the sheets to be joined.

The method for the fastening of sheaves of paper using the above device is as follows: the rod is first introduced into the hole in the sheaf of paper that has been selected for fastening; a fastening sleeve that is strung onto the plastic rod is then introduced and the sleeve is put on gradually by simply moving it down the length of the rod until it is inserted into the relevant hole in the sheaf of paper, until the corresponding checker edge hits against the side of the said sheaf of paper. In this position, the sleeve is firmly held against the plastic rod, since even though it was possible to introduce it with ease because of the elastic deformation of the material, given the conical entry of the rim with the smaller diameter at one end of the inside opening in the sleeve, this rim is partially pushed against the rod mass, which makes its extraction practically impossible. Once the sleeve has been introduced, the remaining part of the rod is cut, perfectly flush at the sleeve end that has the stopper. At this point, the sheaf of paper is fastened in a simple and solid manner. Also, the device has an aesthetically pleasant finish, with one side showing the stopper of the metal sleeve, for example brass or another material, closed and flush with the plastic core, and the other side being closed by the plastic rod stopper.

The sleeve should preferably be made from a metallic material such as brass or another type, and should simply combine characteristics of a certain elasticity for a good fit so that the sleeve fits well between the walls of the holes in the sheaf of paper and the plastic rod inserted into them. Furthermore, it should preferably have rustproof characteristics, so that no corrosion occurs in the sleeve throughout a given utilisation period. In addition to rustproof metallic materials or those coated with zinc or cadmium, it is obviously also possible to use other types of material such as plastics with a sufficient degree of hardness.

In order to achieve greater elasticity of the sleeve, it should preferably have one or several longitudinal cuts to improve radial adjustment.

Also, to facilitate the introduction of the sleeve over the plastic rod, the internal annular section, at one end of the sleeve, should have a wide conical entry to facilitate the fitting of the sleeve.

The internal annular projection at the end of the sleeve can be achieved by means of an annular rim or by separate sections, always ensuring that there is an inside edge which is quite pointed and directed towards the inside of the tubular sleeve, to improve its grip on the walls of the plastic rod.

BRIEF DESCRIPTION OF THE DRAWINGS

For greater clarity some explanatory drawings of both the device and the method of the present invention are enclosed by way of example.

DESCRIPTION OF THE PREFERRED EMBODIMENT

Figure 1:
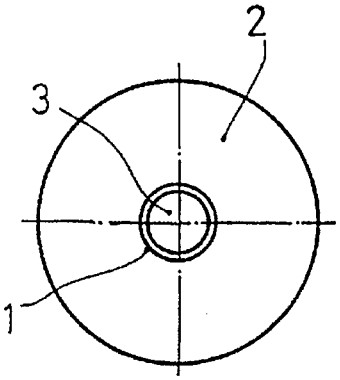
FIGS. 1 and 2 are top and front views respectively, of a binding rod that forms part of the present device.
Figure 3:
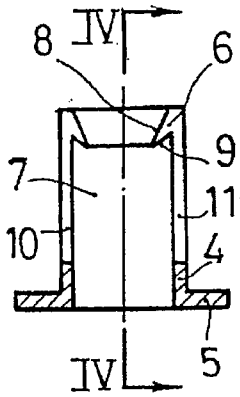
FIGS. 3 and 4 are longitudinal sections of the sleeve along the lines as shown.
Figure 4:
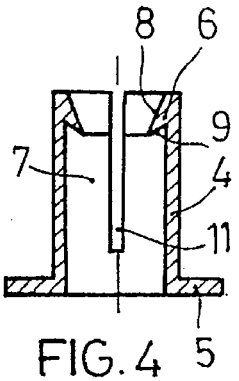
Figure 2:
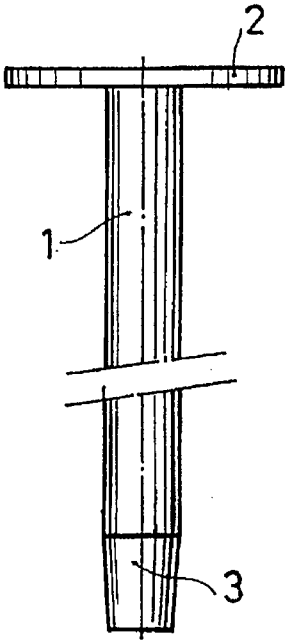
Figure 5:
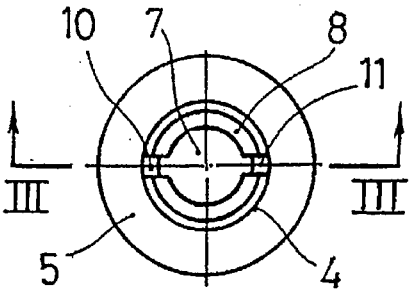
FIG. 5 shows a top view of the sleeve itself from the device.

As shown in the drawings, the device of the present invention comprises a rod -1- preferably made from resistant plastic material having a certain flexibility, that has a stopper -2- at one end and a conical entry -3- at the other, fitted with a hollow cylindrical sleeve -4- which has a stopper -5- at one end and an annular rim or engaging surface -6- at the other, which is directed towards the inside of the internal opening -7- in the sleeve. It is a characteristic of the device that the rim -6- has a wide conical entry -8-, with the larger diameter on the entry edge of the sleeve and the smaller diameter in the internal part of same. This edge preferably has a lower wall -9-, itself at an oblique angle to the symmetrical axis of the sleeve, in order to form a hook shape with the conical entry -8-. Understandably, the precise form of the rim -6- can be variable, as long as the condition of having a conical entry -8- and the aforementioned hook shape is complied with. Thus, for example, as in the present case, the rim can be annular, interrupted only by longitudinal cuts -10- and -11- in the sleeve, aimed at achieving greater flexibility of same by improving its fit and likewise it would be possible to have a separated teeth structure instead of an unbroken annular shape.

Figure 6:
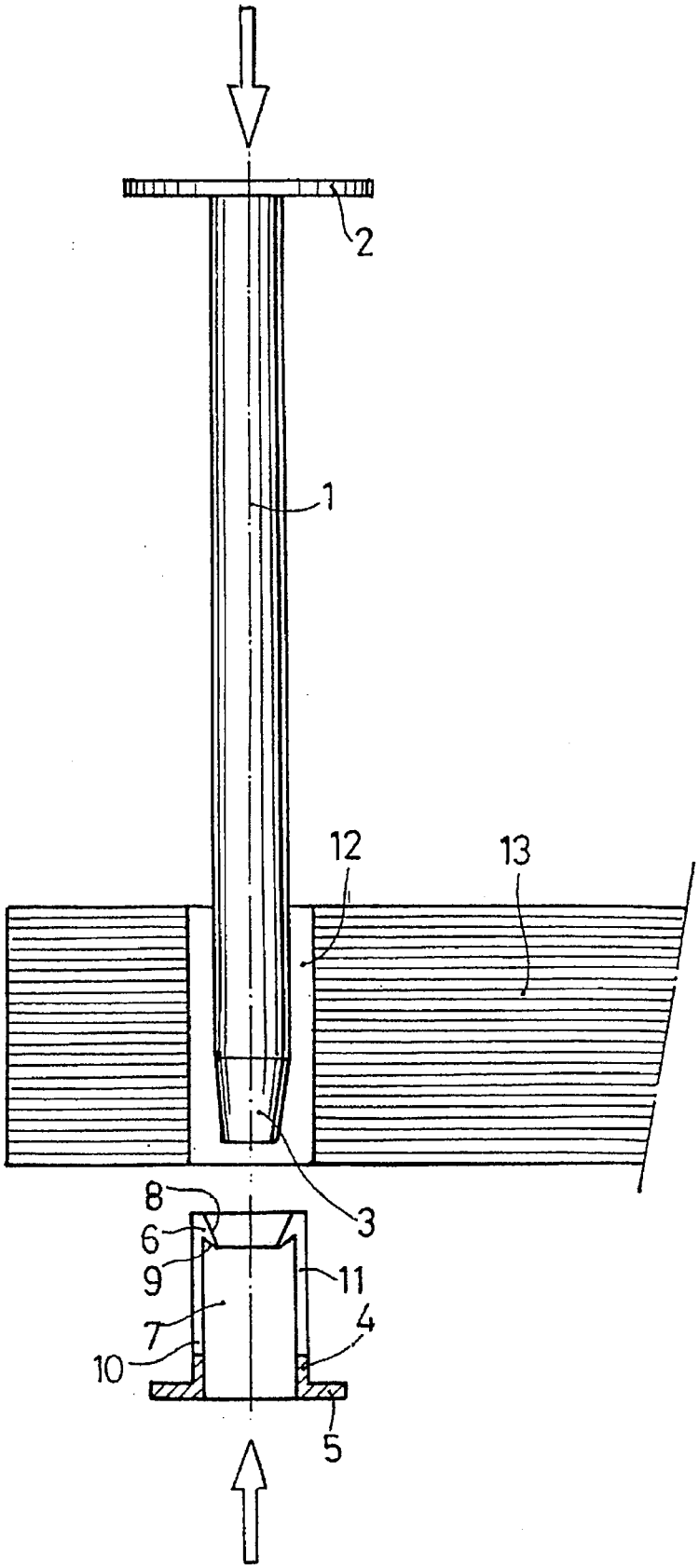
FIG. 6 shows a front view and partial section of parts forming the device, showing the method of application of same.

The use of the device is illustrated in FIG. 6, which shows the rod -1- being introduced into a hole -12- in a sheaf of paper -13-, such as computer lists, which are to be fastened together by binding.

Figure 7:
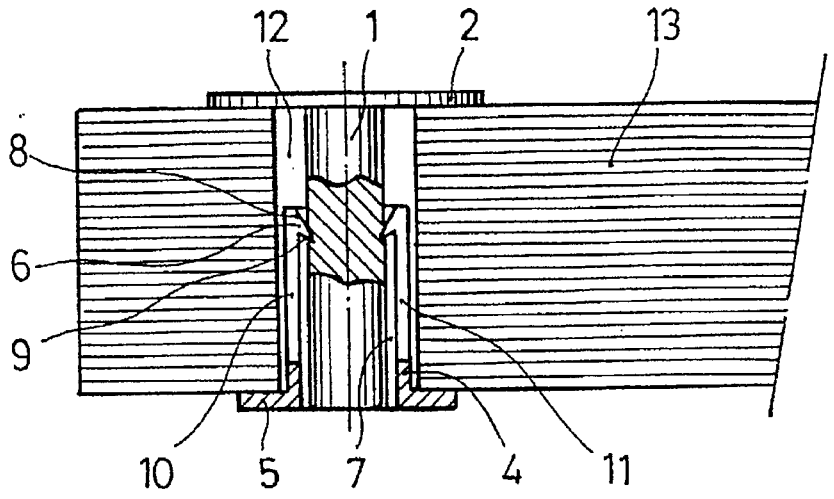
FIG. 7 shows a cross-sectioned view of the device used to bind a sheaf of paper.
Figure 8:
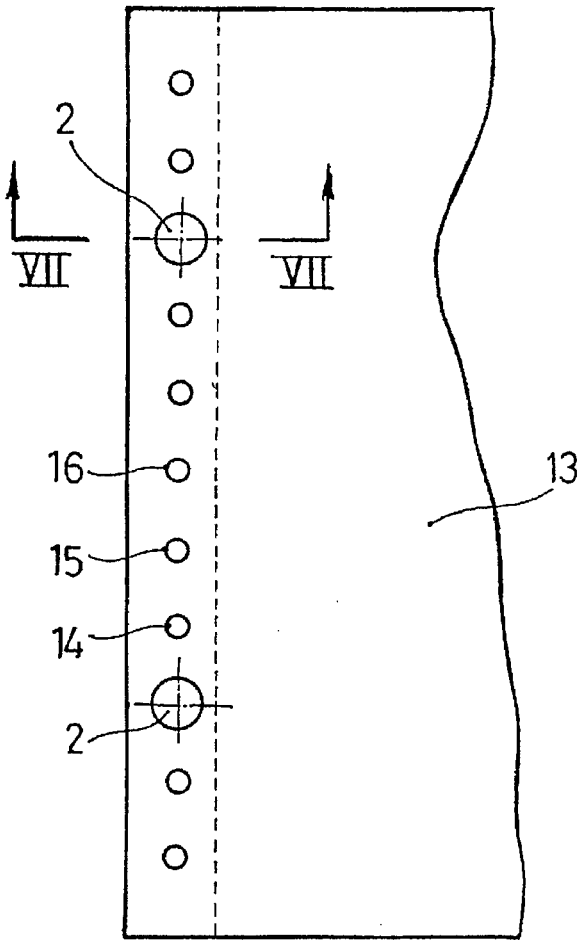
FIG. 8 shows a top view of a sheaf of paper fastened by means of the device of the present invention.
Figure 9:
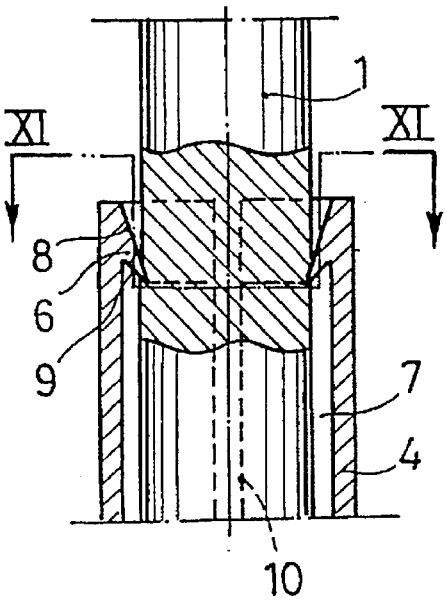
FIGS. 9, 10, 11 and 12 are explanatory sections of the rod and sleeve unit in the device of the present invention.
Figure 10:
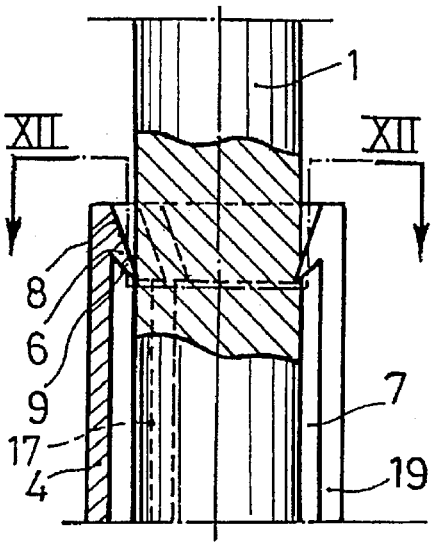
Figure 11:
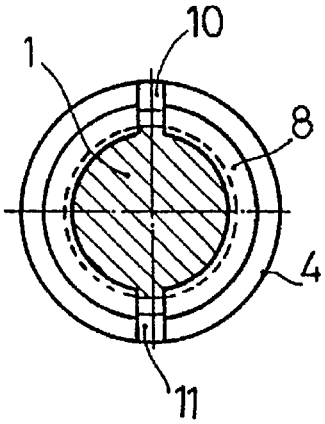

The aforesaid sheaf -13- has multiple holes as shown in FIG. 8, in which the holes were allocated the numerals -14-, -15-, -16-. Once the rod -1- is fully inserted, the stopper -2- fits against the top surface of the sheaf of paper -13- in the immediate vicinity of the hole -12-, such as is shown in FIG. 7. The sleeve, which is then inserted by sliding it along the rod -1- is also checked so that its stopper -5- fits against the underside of the sheaf of paper. The rim which is at the end of the inside opening -7- in the sleeve is slipped over the length of the rod -1- by the action of the conical entry -8-, is partially pushed into the said rod mass -1-, as shown in FIG. 7, in such a manner that it is practically impossible to extract it by means of the pushing action which was explained previously. The rod -1- is cut flush with the stopper -5-, as shown in FIG. 7.

Figure 12:
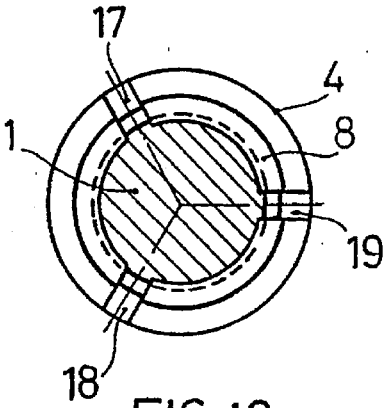

FIG. 12 shows a version in which the sleeve has several longitudinal cuts, i.e. -17-, -18-, and -19-, offering an alternative solution for possibly providing greater adaptability of the sleeve.

Figure 13:
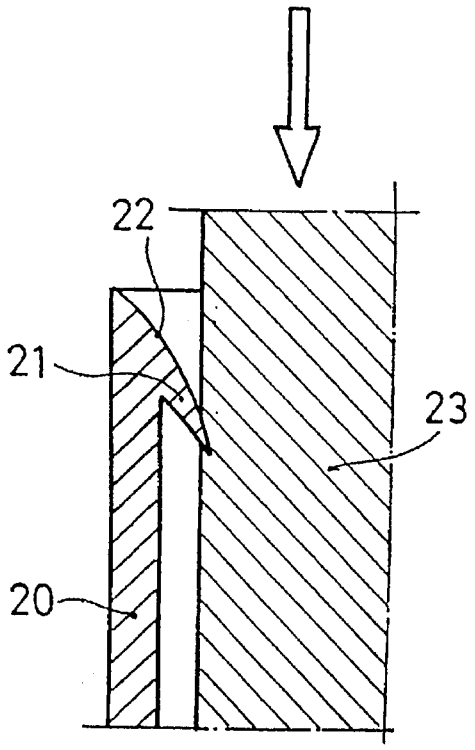
FIGS. 13, 14, 15 and 16 are section details of variants for producing sleeves in accordance with the present invention.
Figure 14:
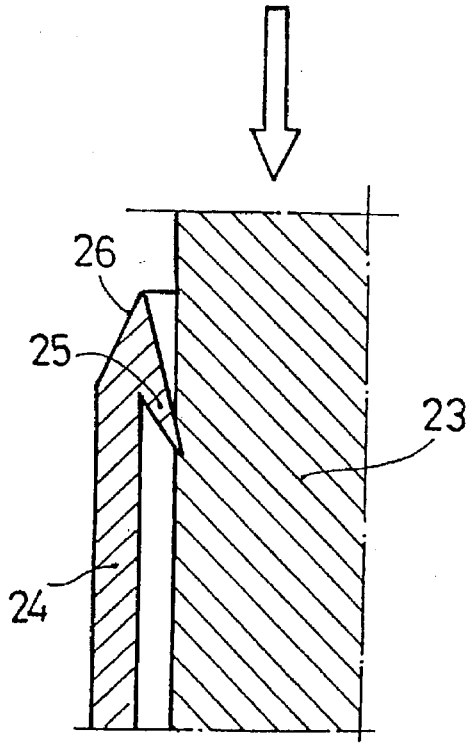

FIGS. 13, 14, 15 and 16 each show variants for producing the internal rim of the sleeve, as with the other methods of production, these are merely explanatory and non-exhaustive. In FIG. 13, the sleeve -20- has a rim -21- with a curved-type entry zone -22- which provides a very pointed edge that can be easily pushed into the rod material -23-. FIG. 14 shows a version in which the sleeve -24- has a rim -25- which is simply achieved by two straight guideline areas inclined towards the inside of the sleeve, which has an entry zone -26-.

Figure 15:
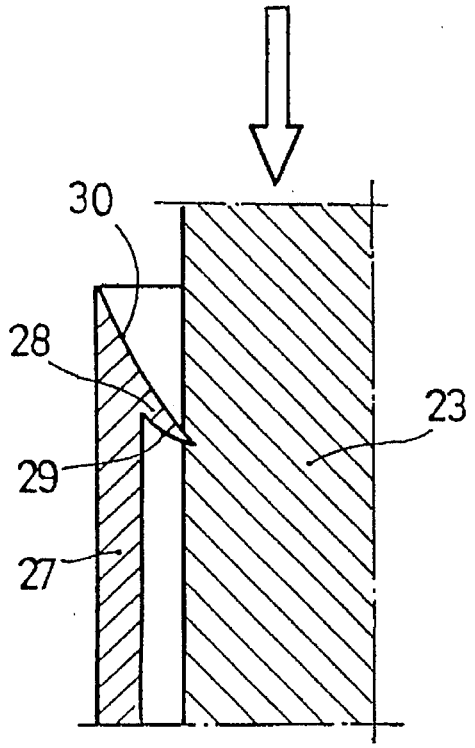

FIG. 15 shows a version in which the sleeve -27- has a rim -28- which is achieved by means of curved surfaces with the convexity pointing upwards -29- and -30-.

Figure 16:
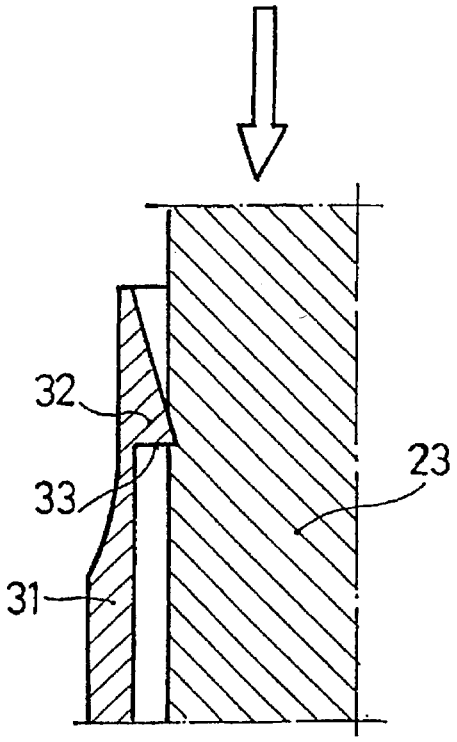

In FIG. 16, the sleeve -31- has an inside step -32- whose lower edge is noticeably perpendicular to the axis of the sleeve; it was allocated the numeral -33-. In this case, the corresponding end of the sleeve is recessed on the outside, to provide a better engagement.

The method for fastening sheaves of perforated paper using the device of the present invention, is characterised in that the rod is first inserted through a hole perforated in the sheaf of paper until abutting on the corresponding face of the sheaf and the sleeve is then inserted over the free end of the rod until it checks against the facing surface of the sheaf of paper, the rod is then cut flush with the stopper head of the sleeve.

We claim:

1. A device for permanent binding of sheaves of paper, the paper having perforations in an area of the binding spine, the device comprising:

a cylindrical synthetic resin rod having a diameter smaller than a diameter of the perforations in the sheaf of paper to be bound, said rod having a taper at one end thereof and a stop surface at an opposite end thereof, a cylindrical hollow sleeve constructed and arranged to be fitted over said rod, said sleeve having an outside diameter slightly smaller than the diameter of the perforations in the papers to be bound and a length less than a thickness of the sheaf of paper to be bound, said sleeve having a sleeve stop surface at a first end thereof constructed and arranged to limit insertion of said sleeve into the sheaf of paper, said sleeve having an internal annular engaging surface in an entry opening defined at a second end thereof, said engaging surface having a diameter slightly smaller than the diameter of said rod such that when said sleeve is moved along the rod, said engaging surface engages said rod to retain said rod to said sleeve once said sleeve stop is engaged with the sheaf, wherein the engaging surface of the sleeve has a pointed edge which is directed towards an inside of the sleeve in a direction opposite to a direction in which it is inserted down the rod.

2. A device for the permanent binding of sheaves of paper, as claimed in claim 1, wherein the sleeve has a wide entry cone defining the entry opening to facilitate introduction of the sleeve over the rod and movement lengthwise of the sleeve down the rod.

3. A device for the permanent binding of sheaves of paper, as claimed in claim 1 or 4, wherein the sleeve is made from rustproof metallic material, or metallic materials coated with anti-corrosives.

4. A device for permanent binding of sheaves of paper, the paper having perforations in an area of the binding spine, the device comprising:

a cylindrical synthetic resin rod having a diameter smaller than a diameter of the perforations in the sheaf of paper to be bound, said rod having a taper at one end thereof and a stop surface at an opposite end thereof, a cylindrical hollow sleeve constructed and arranged to be fitted over said rod, said sleeve having an outside diameter slightly smaller than the diameter of the perforations in the papers to be bound and a length less than a thickness of the shelf of paper to be bound, said sleeve having a sleeve stop surface at a first end thereof constructed and arranged to limit insertion of said sleeve into the sheaf of paper, said sleeve having an internal annular engaging surface in an entry opening defined at a second end thereof, said engaging surface having a diameter slightly smaller than the diameter of said rod such that when said sleeve is moved along the rod, said engaging surface engages said rod to retain said rod to said sleeve once said sleeve stop is engaged with the sheaf, wherein the engaging surface of the sleeve is divided into various sections by axial edges.

5. A device for the permanent binding of sheaves of paper, as claimed in claim 1 or 4, wherein said sleeve stop is in the shape of a flat stopper.

* * * * *